United States Patent [19]

Saito et al.

[11] 4,226,677

[45] Oct. 7, 1980

[54] EARTHQUAKE-PROOF FOUNDATION STRUCTURE FOR HORIZONTAL TYPE COKE OVEN BATTERY

[75] Inventors: Akira Saito; Yushichi Miura; Koichiro Bando, all of Yokohama, Japan

[73] Assignee: Nippon Kokan Kabushiki Kaisha, Tokyo, Japan

[21] Appl. No.: 9,954

[22] Filed: Feb. 6, 1979

[30] Foreign Application Priority Data

Feb. 27, 1978 [JP] Japan ..... 53/21009

[51] Int. Cl.[3] ..... C10B 5/00; C10B 29/08; E02D 27/34

[52] U.S. Cl. ..... 202/138; 52/167; 202/222; 202/270

[58] Field of Search ..... 202/133, 138, 139, 145, 202/222, 223, 270, 140, 141, 142, 143, 144, 146; 52/167; 405/204, 224, 229; 110/336, 349

[56] References Cited

U.S. PATENT DOCUMENTS

| | | | |
|---|---|---|---|
| 440,938 | 11/1890 | Anthoni | 52/167 |
| 896,431 | 8/1908 | Boermel | 52/167 |
| 2,631,841 | 3/1953 | Tillou et al. | 52/167 |
| 3,350,821 | 11/1967 | Jones | 52/167 X |
| 3,762,114 | 10/1973 | Eskijian | 52/573 X |
| 4,121,393 | 10/1978 | Renault et al. | 52/167 |
| 4,133,720 | 1/1979 | Franzer et al. | 52/167 X |

FOREIGN PATENT DOCUMENTS

| | | | |
|---|---|---|---|
| 701311 | 2/1966 | Italy | 52/167 |
| 49-962 | 1/1974 | Japan | 202/138 |

*Primary Examiner*—Frank W. Lutter
*Assistant Examiner*—Roger F. Phillips
*Attorney, Agent, or Firm*—Frishauf, Holtz, Goodman & Woodward

[57] ABSTRACT

An earthquake-proof foundation structure for a horizontal type coke oven battery which comprises: a pile plate rigidly connected substantially in a horizontal position to the tops of a plurality of foundation piles; a base plate for mounting thereon a horizontal type coke oven battery, said base plate being placed substantially in a horizontal position on said pile plate; two sliding layers, each arranged between said pile plate and said base plate and between said base plate and said coke oven battery, each of said two sliding layers being formed by tightly laying a plurality of steel sheets coated with graphite grease over the entire surface thereof into two or three laminations; the lower surface of said coke oven battery or the upper surface of said base plate being provided with a longitudinal ridge and a plurality of transverse ridges, while the upper surface of said base plate or the lower surface of said coke oven battery being provided with a longitudinal groove and a plurality of transverse grooves to engage with said longitudinal and transverse ridges at locations corresponding to said ridges; and said pile plate and said base plate being connected to each other on the both longitudinal sides thereof by a plurality of buffers each of which comprises a bolt fixed with a plurality of reinforcing ribs at the lower portion thereof and an elastic ring engaging with the upper portion of said bolt.

3 Claims, 4 Drawing Figures

EARTHQUAKE-PROOF FOUNDATION STRUCTURE FOR HORIZONTAL TYPE COKE OVEN BATTERY

REFERENCE TO PATENTS, APPLICATIONS AND PUBLICATIONS PERTINENT TO THE INVENTION

As far as we know, the prior document pertinent to the present invention is Japanese Patent Publication No. 962/74 dated Jan. 10, 1974 which matured into Japanese Pat. No. 743,738, corresponding to West-German Pat. application No. P1708549.3 dated Jan. 22, 1968. The prior art disclosed in said document will be described in the "Background of the Invention" given herebelow.

FIELD OF THE INVENTION

The present invention relates to an earthquake-proof foundation structure for a horizontal type coke oven battery.

BACKGROUND OF THE INVENTION

A conventional horizontal type coke oven battery for manufacturing metallurgical coke comprises a plurality of coking ovens for carbonizing coal charge, a plurality of combustion chambers for burning fuel gas, a regenerator for storing remaining heat of the combustion waste gas from the combustion chambers, and a sole flue for directing the combustion waste gas after heat exchange in the regenerator to a stack. Said plurality of coking chambers and combustion chambers are alternately arranged in the horizontal direction on the regenerator. Each of the combustion chambers comprises a plurality of heating flues, where fuel gas is burnt to heat and carbonize coal charge in the coking ovens on the both sides of the coking chamber through the oven walls, and thus to manufacture coke. The sole flue is installed outside and below the regenerator on the both longitudinal sides thereof, or directly below the regenerator. above described structure is a very large-scale structure easily subjected to damage, built by piling up a large number of bricks. The foundation structure for such a coke oven battery should therefore, in the occurrence of earthquake, not only be capable of largely reducing the input acceleration of a seismic wave transmitted to the coke oven battery to minimize the maximum relative displacement, the residual displacement and the acceleration produced in the coke oven battery, but also permit smooth release of expansion and contraction moments of the coke oven battery under the effect of heat, thereby preventing damage to the coke oven battery caused by the input acceleration of a seismic wave and/or expansion and contraction under the effect of temperature change.

With this requirement in view, several earthquake-proof foundation structure for a horizontal type coke oven battery have been proposed. For example, Japanese Patent Publication No. 962/74 dated Jan. 10, 1974, which matured into Japanese Pat. No. 743,738, corresponding to West-German patent application No. P1708549.3 dated Jan. 22, 1968 discloses an earthquake-proof foundation structure for a horizontal type coke oven battery having a sole flue outside and below the regenerator on the both longitudinal sides, which comprises:

a base plate; a supporting plate for mounting thereon said horizontal type coke oven battery; a plurality of columnar supports arranged substantially in a vertical position in the space between said base plate and said supporting plate; a buffer for absorbing the input acceleration of a seismic wave in the longitudinal direction of the coke oven battery, provided near the middle of the longitudinal center line of said space (hereinafter referred to as the "longitudinal buffer"); and buffers for absorbing the input acceleration of a seismic wave in the transverse direction of the coke oven battery, provided in two sets each within the ranges of $\frac{1}{4}$ from the both ends of said longitudinal center line (hereinafter referred to as the "transverse buffer"); said supporting plate being supported on said base plate by means of said plurality of supports; said horizontal type coke oven battery being mounted on said supporting plate; each of said plurality of supports being connected substantially in a vertical position to said supporting plate and said base plate, movably in any direction through a bearing at the head portion and the leg portion thereof; each of said longitudinal buffer and said transverse buffers comprising two opposite projections fixed to the upper surface of said base plate and a projection fixed to the lower surface of said supporting plate, said projection fixed to the lower surface of said supporting plate projecting into the space between said two projections fixed to the upper surface of said base plate, and an elastic body being provided in each of the gaps between said two projections fixed to the upper surface of said base plate and said projection fixed to the lower surface of said supporting plate.

In the earthquake-proof foundation structure having the aforementioned structure, the input acceleration of a seismic wave in all directions transmitted from the ground to the base plate is absorbed by the longitudinal buffer and/or the transverse buffers. It is therefore possible to largely reduce the input acceleration of a seismic wave transmitted to the coke oven battery mounted on the supporting plate and hence to prevent damage to the coke oven battery caused by an earthquake. The horizontal transverse force applied to the coke oven battery by a pusher is abosrbed by the transverse buffers. Furthermore, since the difference in expansion and contraction caused by a change in temperature between the base plate and the supporting plate is absorbed by the plurality of supports movable in all directions, no bending moment is produced between the base plate and the supporting plate.

In the above-mentioned earthquake-proof foundation structure, however, each of the plurality of supports is connected substantially in a vertical position to the supporting plate and the base plate, movably in all directions through a bearing at the head portion and the leg portion thereof. Therefore, when the input acceleration of a seismic wave produces a considerable relative displacement between the base plate and the supporting plate, and as a result, said pluraity of supports largely incline, there is a serious fear that said plurality of supports having thus inclined may not be able to withstand the load of the coke oven battery mounted on the supporting plate. The coke oven battery is mounted directly on the supporting plate without no sliding layer in between. Therefore, even if no bending moment is produced between the base plate and the supporting plate as mentioned above, a bending moment caused by a change in temperature may be produced between the supporting plate and the lower surface of the coke oven battery.

An earthquake-proof foundation structure for a horizontal type coke oven battery having a sole flue directly below the regenerator, as shown in the schematic transverse vertical section view given in FIG. 1 has been proposed, which is the most pertinent to the present invention.

In FIG. 1, 1' are a plurality of foundation piles driven substantially vertically into the ground; 2' is a pile plate comprising solid concrete, rigidly connected substantially in a horizontal position to the tops of said plurality of foundation piles 1'; 3' is a base plate comprising solid concrete for mounting thereon a horizontal type coke oven battery described later, said base plate 3' being placed substantially in a horizontal position on said pile plate 2' through a sliding layer 6'; and 4' is a horizontal type coke oven battery comprising a regenerator 4a', a plurality of coking ovens and combustion chambers 4b' alternately arranged in the horizontal direction on said regenerator 4a', and a sole flue 5' installed directly below said regenerator 4a'. Said coke oven battery 4' is mounted on said base plate 3' through a sliding layer 7'. Each of the sliding layers 6' and 7' is formed by tightly laying a plurality of about 1-mm thick steel sheets coated with graphite grease over the entire surface thereof into two or three laminations. However, among the surfaces of said plurality of steel sheets, those being in contact with the upper surface of the pile plate 2', the lower surface of the base plate 3', the upper surface of the base plate 3' and the lower surface of the bottom 5a' of the sole flue 5' of the coke oven battery 4' are not coated with graphite grease. Said plurality of steel sheets may have any dimensions, and said plurality of steel sheets are tightly laid into two or three laminations by bringing their end edges into butt contact so that there may be neither gap nor overlap between their end edges. Incidentally, 17' is a heat-insulation layer comprising refractory, which covers the upper surface of the base plate 3'.

According to the earthquake-proof foundation structure shown in FIG. 1 comprising the foundation piles 1', the pile plate 2', the base plate 3' and the sliding layers 6' and 7', the input acceleration of a seismic wave transmitted to the coke oven battery 4' is reduced by the sliding layers 6' and 7', thus permitting prevention of a damage to the coke oven battery 4' caused by an earthquake. It is also possible, under the effect of the sliding layer 7', to smoothly release expansion and contraction moments caused by a change in temperature of the bottom 5a' of the sole flue 5' of the coke oven battery 4'.

The theory regarding such an earthquake-proof effect of the foundation structure shown in FIG. 1 is based on the following fundamental concept. More specifically, the sliding layers 6' and 7' are considered to have a frictional coefficient of 0.2 as the design value. Therefore, when the input acceleration of a seismic wave is transmitted through the ground, the foundation piles 1', the pile plate 2', the sliding layer 6', the base plate 3' and the sliding layer 7' to the coke oven battery 4', the acceleration produced in the coke oven battery 4' is not considered to exceed 200 gal corresponding to the frictional coefficient of 0.2 as shown in the following equation:

Gravitational acceleration "g" = 980 cm/s$^2$ $$g \times 0.2 = 980\ \text{cm/s}^2 \times 0.2 = 196\ \text{gal} \approx 200\ \text{gal}$$

Therefore, in the case where the input acceleration of a seismic wave transmitted to the pile plate 2' through the foundation pile 1' is up to 200 gal, there occurs no relative displacement among the pile plate 2', the base plate 3' and the coke oven battery 4', these moving as an integral body by the friction, and thus, no adverse effect of earthquake exerts on the coke oven battery 4'. On the other hand, in the case where the input acceleration of a seismic wave transmitted to the pile plate 2' through the foundation pile 1' is over 200 gal, only the pile plate 2' moves in a behavior corresponding to the seismic wave under the effect of the sliding layers 6' and 7', and the base plate 3' and the coke oven battery 4' are kept in the stationary state. In an earthquake of any magnitude, therefore, it has been considered that no residual displacement would be produced among the pile plate 2', the base plate 3' and the coke oven battery 4'.

According to the aforementioned fundamental concept concerning the earthquake-proof effect of the foundation structure shown in FIG. 1, if the frictional coefficient of the sliding layers 6' and 7' is close to zero, almost no input acceleration of a seismic wave would be transmitted to the coke oven battery 4', and in an earthquake of any magnitude, the coke oven battery 4' would be kept in the ideal stationary state. We have however noticed that there are the following serious doubts in the conventional fundamental concept regarding the earthquake-proof effect mentioned above:

(1) It is doubtful whether or not the graphite grease of the sliding layers 6' and 7' have actually a frictional coefficient of 0.2 just as designed;

(2) the frictional mechanism of the sliding layers 6' and 7' including graphite grease is presumed to include not only a simple static friction, but also a viscous friction;

(3) because the sliding layers 6' and 7' have no function to inhibit inertia force produced in the coke oven battery 4' in an earthquake, the coke oven battery 4' is placed in an unstable state at the time of earthquake. Depending upon the magnitude of the earthquake, therefore, considerable relative displacement and residual displacement may be produced in the coke oven battery 4'.

SUMMARY OF THE INVENTION

A principal object of the present invention is therefore to provide an earthquake-proof foundation structure for a horizontal type coke oven battery, which is not only capable of largely reducing the input acceleration of a seismic wave transmitted to the horizontal type coke oven battery, thus considerably minimizing the maximum relative displacement, the residual displacement and the acceleration produced in said coke oven battery, but also capable of keeping said coke oven battery in a stable state in an earthquake.

Another object of the present invention is to provide a foundation structure for a horizontal type coke oven battery, which is capable of smoothly releasing the expansion and contraction moments of the horizontal type coke oven battery caused by heat.

In accordance with one of the features of the present invention, there is provided an earthquake-proof foundation structure for a horizontal type coke oven battery, which comprises:

a plurality of foundation piles driven substantially vertically into the ground;

a pile plate rigidly connected substantially in a horizontal position to the tops of said plurality of foundation piles;

a base plate for mounting thereon a horizontal type coke oven battery, said base plate being placed substantially in a horizontal position on said pile plate, said coke oven battery comprising a regenerator, a plurality of coking ovens and combustion chambers alternately arranged in the horizontal direction on said regenerator, and a sole flue installed directed below said regenerator; and two sliding layers each arranged between said pile plate and said base plate and between said base plate and said sole flue of said coke oven battery, each of said two sliding layers being formed by tightly laying a plurality of steel sheets coated with graphite grease over the entire surface thereof into two or three laminations, among the surfaces of said plurality of steel sheets, those being in contact with the upper surface of said pile plate, the lower surface of said base plate, the upper surface of said base plate and the lower surface of said sole flue of said coke oven battery not being coated with graphite grease;

said foundation structure being characterized in that:

the lower surface of said sole flue of said coke oven battery or the upper surface of said base plate is provided with a longitudinal ridge and a plurality of transverse ridges, while the upper surface of said base plate or the lower surface of said sole flue of said coke oven battery is provided with a longitudinal groove and a plurality of transverse grooves to engage with said longitudinal ridge and said plurality of transverse ridges at locations corresponding to said ridges, thereby said coke oven battery being mounted on said base plate in a state in which said longitudinal ridge and said plurality of transverse ridges respectively engage with said longitudinal groove and said plurality of transverse grooves corresponding thereto; and said pile plate and said base plate are connected to each other on the both longitudinal sides thereof by a plurality of buffers each of which comprises a bolt fixed with a plurality of reinforcing ribs at the lower portion thereof and an elastic ring engaging with the upper portion of said bolt.

DETAILED DESCRIPTION OF PREFERRED EMBODIMENTS

Figure 1:
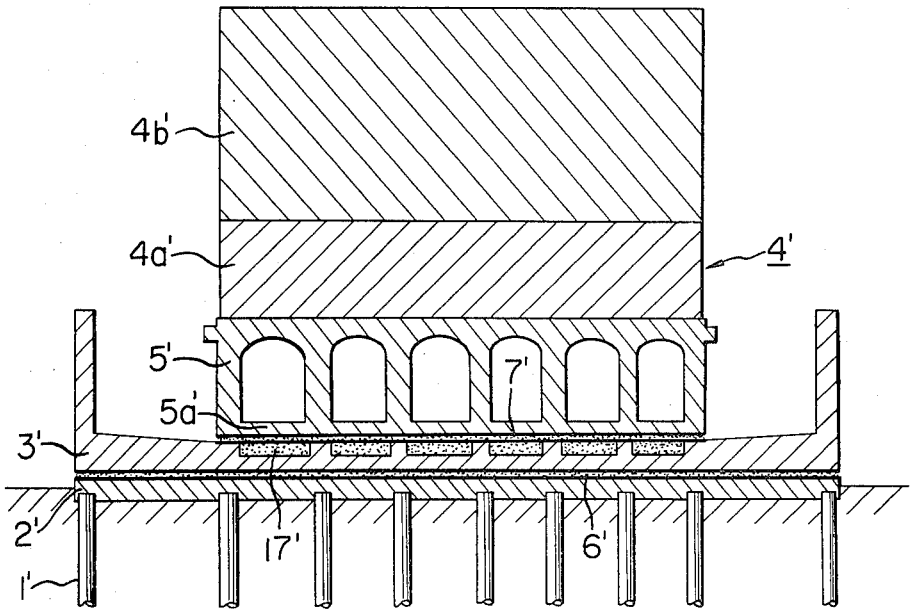
FIG. 1 is a schematic transverse vertical section view illustrating a conventional earthquake-proof foundation structure for a horizontal type coke oven battery.

With a view to clarifying the above-mentioned defects and doubts involved in the conventional earthquake-proof foundation structures for a horizontal type coke oven battery, we have conducted extensive studies through a preliminary sliding test, a vibration test, a horizontal loading test and an earthquake response simulation as described below.

(1) Preliminary sliding test:

With regard to a sliding layer comprising a steel sheet coated with graphite grease, a vertical two-side sliding test and a horizontal one-side sliding test were carried out with the use of a 10-ton loading machine to measure the frictional coefficient of said sliding layer. Said vertical two-side sliding test was carried out by substantially vertically holding a steel sheet coated with graphite grease on the both surfaces, applying a horizontal load to the both surfaces of said steel sheet, and vertically moving said steel sheet. Said horizontal one-side sliding test was conducted by substantially horizontally placing on a table a steel sheet coated with graphite grease on only one surface with the surface coated with graphite grease as the underside, applying a vertical load to the upper surface not coated with graphite grease of said steel sheet, and horizontally moving said steel sheet.

The results of measurement of the frictional coefficient of the sliding layer in the above-mentioned preliminary sliding test are shown in Table 1.

TABLE 1

| Sliding speed | Frictional coefficient of sliding layer: Surface pressure 0.4 kg/cm$^2$ | Surface pressure 0.8 kg/cm$^2$ | Surface pressure 1.2 kg/cm$^2$ |
|---|---|---|---|
| 0.25 mm/minute | 0.024 | 0.015 | 0.008 |
| 1.0 mm/minute | 0.025 | 0.018 | 0.010 |
| 2.5 mm/minute | 0.040 | 0.026 | 0.022 |

It became evident from the results of measurement shown in Table 1 that the frictional coefficient of a sliding layer comprising a steel sheet coated with graphite grease decreases according as the surface pressure increases, and increases according as the sliding speed increases, and that the frictional coefficient of said sliding layer is considerably smaller than the design value of 0.2 described above.

(2) Vibration test:

A steel sheet coated with graphite grease on only one surface was substantially horizontally placed on the vibration table of a vibration test equipment with the surface not coated with graphite grease as the underside. A model coke oven battery weighing 650 kg was mounted on the upper surface coated with graphite grease of said steel sheet. An input with a maximum acceleration of 250 gal having the same wave form as that in the earthquake having occurred in Hachinohe, Japan and that in El Centro to the south of Los Angeles, U.S.A. was applied to said vibration table by said vibration test equipment to measure the acceleration and the residual displacement produced in said model coke oven battery.

The results of said measurement including a maximum acceleration produced in said model coke oven battery of 170 gal and a residual displacement of 6 mm–9 mm indicated that the residual displacement of said model increases according as the input acceleration increases.

(3) Horizontal loading test:

A model pile plate was substantially horizontally placed on the table of a horizontal loading test equipment. A model base plate was placed on said model pile plate through a sliding layer comprising two steel sheets with graphite grease sandwitched in between. A loading pressure was applied onto said model base plate as a substitute for a coke oven battery. While changing said loading pressure, said model base plate was horizontally moved by the hydraulic jack of said horizontal loading test equipment to measure the frictional coefficient of said sliding layer for each of the value of the loading pressure.

The results of measurement of the frictional coefficient of the sliding layer in the above-mentioned horizontal loading test are given in Table 2.

TABLE 2

| | Loading pressure | | |
|---|---|---|---|
| | 1.6 t/m$^2$ | 5.8 t/m$^2$ | 10.0 t/m$^2$ |
| Average value of frictional coefficient of sliding layer | 0.037 | 0.014 | 0.009 |

The results of measurement shown in Table 2 revealed that the frictional coefficient of the sliding layer comprising two steel sheets with graphite grease sandwiched in between is considerably smaller than the above-mentioned design value of 0.2. Also, these test results clearly indicate, as considered in combination with the test results of (1) and (2) above, that the frictional mechanism of said sliding layer shows the behavior of viscosity rather than that of the static friction.

(4) Earthquake response simulation:

With regard to a conventional earthquake-proof foundation structure for a horizontal type coke oven battery having two sliding layers each formed by laying a plurality of steel sheets coated with graphite grease on the entire surface thereof into two or three laminations, arranged respectively between the pile plate and the base plate and between the base plate and the horizontal type coke oven battery, an earthquake response simulation calculation of the coke oven battery was performed on the basis of the test results of (1) and (3) above, under the following conditions:

(a) Weight of the coke oven battery: 35,000 tons;
(b) frictional coefficient of the sliding layers: 0.02;
(c) viscosity coefficient of the sliding layers:
at the beginning of sliding: 8 t/m$^2$/m/sec,
after sliding: 1 t/m$^2$/m/sec;
(d) maximum input acceleration of the seismic wave: 150 gal, 200 gal, and 250 gal; and
(e) wave form of the input seismic wave:
14 kinds of seismic waves including those corresponding to the earthquake at El Centro to the south of Los Angeles, U.S.A. and at Taft to the north of Los Angeles, U.S.A.

The results of the aforementioned simulation calculation are shown in Table 3.

TABLE 3

| | | Produced in coke oven battery | | |
|---|---|---|---|---|
| | | Average value of maximum relative displacement | Average value of residual displacement | Average Value of maximum acceleration |
| Maximum input acceleration of seismic wave | 150 gal | 4.6 cm | 2.6 cm | 31 gal |
| | 200 gal | 8.1 cm | 4.9 cm | 33 gal |
| | 250 gal | 12.0 cm | 7.0 cm | 34 gal |

The results of simulation calculation given in Table 3 revealed that, in the earthquake-proof foundation structure mentioned above, the maximum acceleration produced in the coke oven battery is very small as compared with the maximum input acceleration of the seismic wave, suggesting the effectiveness of the earthquake-proof effect, whereas the maximum relative displacement and the residual displacement produced in the coke oven battery are considerably larger than the allowable limits including a maximum relative displacement of about 3 cm and a residual displacement of about 2 cm, suggesting a very unstable state of the coke oven battery in an earthquake.

The present invention has been made on the basis of the results of the tests and the simulation mentioned under (1) to (4) above, and the earthquake-proof foundation structure for a horizontal type coke oven battery of the present invention comprises:

a plurality of foundation piles driven substantially vertically into the ground;

a pile plate rigidly connected substantially in a horizontal position to the tops of said plurality of foundation piles;

a base plate for mounting thereon a horizontal type coke oven battery, said base plate being placed substantially in a horizontal position on said pile plate, said coke oven battery comprising a regenerator, a plurality of coking ovens and combustion chambers alternately arranged in the horizontal direction on said regenerator, and a sole flue installed directly below said regenerator; and two sliding layers each arranged between said pile plate and said base plate and between said base plate and said sole flue of said coke oven battery, each of said two sliding layers being formed by tightly laying a plurality of steel sheets coated with graphite grease over the entire surface thereof into two or three laminations, among the surfaces of said plurality of steel sheets, those being in contact with the upper surface of said pile plate, the lower surface of said base plate, the upper surface of said base plate and the lower surface of said sole flue of said coke oven battery not being coated with graphite grease;

said foundation structure being characterized in that;

the lower surface of said sole flue of said coke oven battery or the upper surface of said base plate is provided with a longitudinal ridge and a plurality of transverse ridges, while the upper surface of said base plate or the lower surface of said sole flue of said coke oven battery is provided with a longitudinal groove and a plurality of transverse grooves to engage with said longitudinal ridge and said plurality of transverse ridges at locations corresponding to said ridges, thereby said coke oven battery being mounted on said base plate in a state in which said longitudinal ridge and said plurality of transverse ridges respectively engage with said longitudinal groove and said plurality of transverse grooves corresponding thereto; and said pile plate and said base plate are connected to each other on the both longitudinal sides thereof by a plurality of buffers each of which comprises a bolt fixed with a plurality of reinforcing ribs at the lower portion thereof and an elastic ring engaging with the upper portion of said bolt.

Now the earthquake-proof foundation structure for a horizontal type coke oven battery of the present invention is described further in detail by means of an example with reference to the drawings.

EXAMPLE

Figure 2:
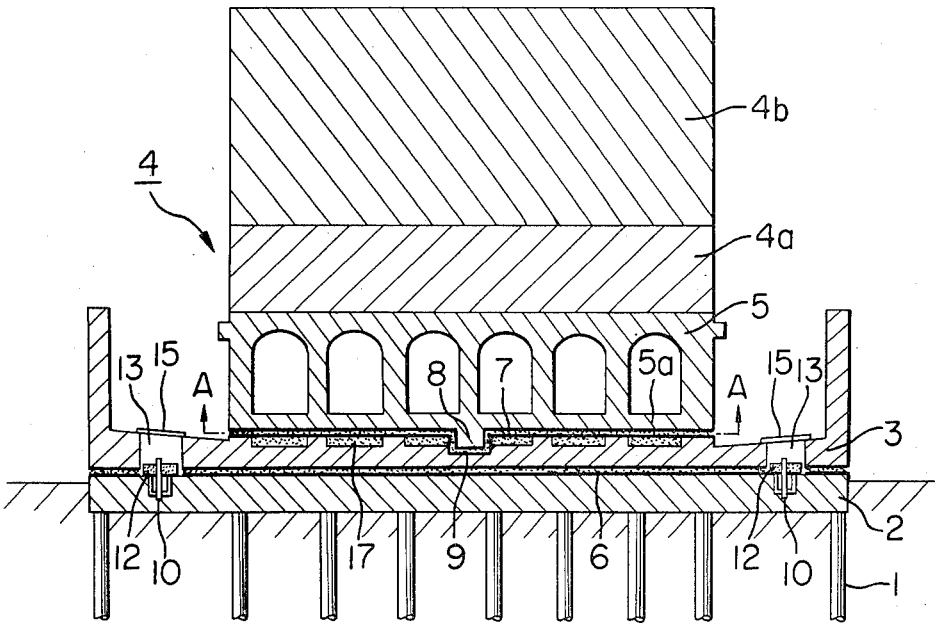
FIG. 2 is a schematic transverse vertical section view illustrating an embodiment of the earthquake-proof foundation structure for a horizontal type coke oven battery of the present invention.
Figure 3:
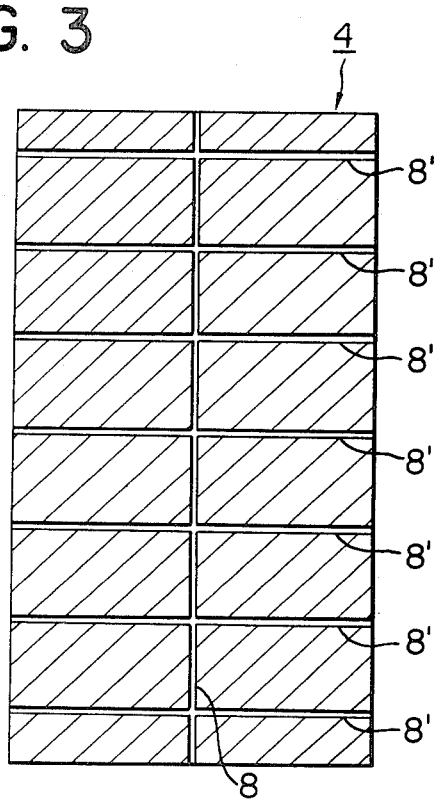
FIG. 3 is a schematic section view of FIG. 2 cut along the line A—A.
Figure 4:
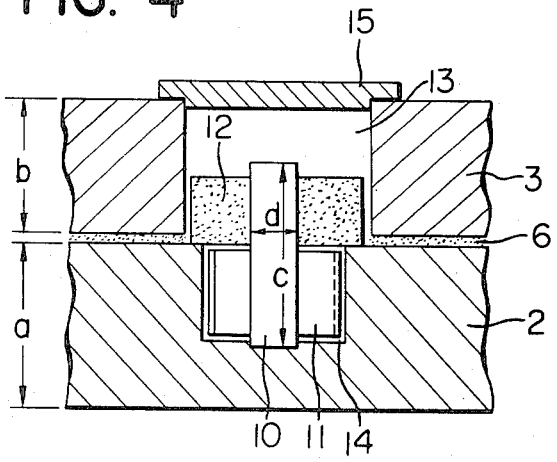
FIG. 4 is an enlarged schematic vertical section view illustrating an embodiment of the buffer employed in the earthquake-proof foundation structure for a horizontal type coke oven battery of the present invention.

FIGS. 2 to 4 illustrate the foundation structure for a horizontal type coke oven battery of the present invention. In FIGS. 2 to 4, 1 are plurality of foundation piles driven substantially vertically into the ground; 2 is a pile plate comprising solid concrete, rigidly connected substantially in a horizontal position to the tops of said plurality of foundation piles 1; 3 is a base plate comprising solid concrete for mounting thereon a horizontal type coke oven battery described later, said base plate 3 being placed substantially in a horizontal position on said pile plate 2 through a sliding layer 6; and 4 is a horizontal type coke oven battery comprising a regenerator 4*a*, a plurality of coking ovens and combustion chambers 4*b* alternately arranged in the horizontal direction on said regenerator 4*a*, and a sole flue 5 installed directly below said regenerator 4*a*. Said coke oven battery 4 is mounted on said base plate 3 through a sliding layer 7. Each of the sliding layers 6 and 7 is formed by tightly laying a plurality of about 1-mm thick steel sheets coated with graphite grease over the entire surface thereof into two or three laminations. However, among the surfaces of said plurality of steel sheets, those being in contact with the upper surface of the pile plate 2, the lower surface of the base plate 3, the upper surface of the base plate 3 and the lower surface of the bottom 5*a* of the sole flue 5 of the coke oven battery 4 are not coated with graphite grease. Said plurality of steel sheets may have any dimensions, and said plurality of steel sheets are tightly laid into two or three laminations by bringing their end edges into butt contact so that there may be neither gap nor overlap between their end edges. Incidentally, 17 is a heat-insulation layer comprising refractory, which covers the upper surface of the base plate 3.

The foundation pile 1, the pile plate 2, the base plate 3 and the sliding layers 6 and 7, which are the basic components of the earthquake-proof foundation structure of the present invention, and the horizontal type coke oven battery 4 to be mounted on the base plate 3 are substantially the same as the foundation pile 1', the pile plate 2', the base plate 3' and the sliding layers 6' and 7', and the conventional horizontal type coke oven battery 4' to be mounted on the base plate 3'.

One of the features of the present invention lies in that, as shown in FIGS. 2 and 3, the lower surface of the bottom 5*a* of the sole flue 5 of the coke oven battery 4 is provided with a longitudinal ridge 8 substantially at the center portion thereof, whereas the upper surface of the base plate 3 is provided with a longitudinal groove 9 to engage with said ridge 8 at the location corresponding to said longitudinal ridge 8 thereof. Furthermore, as shown in FIG. 3, the lower surface of the bottom 5*a* of the sole flue 5 of the coke oven battery 4 is provided with a plurality of transverse ridges 8' substantially at equal intervals in parallel to each other, whereas the upper surface of the base plate 3 is provided with a plurality of transverse grooves (not shown) to engage with said plurality of transverse ridges 8' at the locations corresponding to said ridges 8' thereof. FIG. 3 illustrates an embodiment in which seven transverse ridges 8' are provided. However, it is needless to mention that the number of transverse ridges 8' is not limited to seven, but should be decided from designing considerations depending upon the weight and the dimensions of the coke oven battery to be mounted.

The above described sliding layers 7 are arranged in a bent form to match with the shape of said longitudinal rige 8 and said plurality of transverse ridges 8', hence with the shape of said longitudinal groove 9 and said plurality of transverse grooves. The coke oven battery 4 is therefore mounted on the base plate 3 in a state in which said longitudinal ridge 8 and said plurality of transverse ridges 8' respectively engage with said longitudinal groove 9 and said plurality of transverse grooves corresponding thereto through the sliding layer 7.

Another feature of the earthquake-proof foundation structure of the present invention is that the pile plate 2 and the base plate 3 mentioned above are connected to each other by a plurality of buffers. Each of said plurality of buffers comprises a bolt fixed with a plurality of reinforcing ribs at the lower portion thereof and an elastic rubber ring engaging with the upper portion of said bolt as shown in FIGS. 2 and 4. In FIGS. 2 and 4, 10 is a bolt; 11 are a plurality of reinforcing ribs fixed by welding to the lower portion of the bolt 10; 12 is an elastic rubber ring engaging with the upper portion of the bolt 10; 13 are a plurality of fitting holes having a diameter which permits insertion of the rubber ring 12, pierced at prescribed intervals on the both longitudinal sides of the base plate 3; 14 are a plurality of fitting recesses having a diameter which permits insertion of the lower portion of the bolt 10 fixed with the reinforcing ribs 11, provided on the upper surface of the pile plate 2 at the locations corresponding to said fitting holes 13; and 15 are covers of the fitting holes. The elastic body, which should preferably be a rubber ring, is not necessarily limited to a rubber ring, but may be any elastic ring with a prescribed spring constant.

As shown in FIGS. 2 and 4, each of the buffers of the present invention is fitted to the pile plate 2 and the base plate 3 substantially in a vertical position by inserting the plurality of reinforcing ribs 11 fixed to the bolt 10 into the fitting recess 14 provided on the upper surface of the pile plate 2 through the fitting hole 13 pierced in the base plate 3 and by inserting the rubber ring 12 into the fitting hole 13 to cause said rubber ring 12 to engage with the upper portion of the bolt 10. Thus, the pile plate 2 and the base plate 3 are connected to each other by the plurality of buffers on the both sides in the longitudinal direction thereof. Incidentally, holes are pierced in the sliding layer 6 at the locations corresponding to the plurality of fitting holes 13.

As mentioned above, each of the buffers is inserted into the fitting hole 13 of the base plate 3 and the fitting recess 14 of the pile plate 2. Therefore, when the bolt 10 of the buffer is bent or damaged, the bolt 10 can be easily replaced. However, the bolt 10 is never bent or damaged if the bolt 10 has a diameter sufficient to withstand any horizontal force which may be applied to the bolt 10. The lower portion of the bolt 10 fixed with the reinforced ribs may therefore be directly burried into the upper surface of the pile plate 2, without providing the fitting recess 14 as mentioned above on the upper surface of the pile plate 2. In this case, the lower portion of the bolt 10 fixed with the reinforcing ribs is previously burried substantially vertically at prescribed intervals into the upper surface of the pile plate 2 on the both side in the longitudinal direction thereof, and the rubber ring 12 is inserted into the fitting hole 13 pierced in the base plate 3 at the location corresponding to the bolt 10, to cause said rubber ring 12 to engage with the upper portion of the bolt 10.

With regard to the earthquake-proof foundation structure constructed as above, an earthquake response simulation of the coke oven battery 4 was carried out under the following conditions while changing the spring constant of the elastic rubber ring 12:

(a) weight of the coke oven battery: 35,000 tons;
(b) spring constant of the rubber ring: 7,000 t/m, 14,000 t/m and 28,000 t/m;
(c) maximum input acceleration of the seismic wave: 200 gal; and
(d) wave form of the input seismic wave: 14 kinds of seismic waves including those corresponding to the earthquake at El Centro to the south of Los Angeles, U.S.A. and at Taft to the north of Los Angeles, U.S.A.

The results of the aforementioned simulation calculation are given in Table 4.

TABLE 4

| Spring constant of rubber ring | Produced in coke oven battery: Average value of maximum relative displacement | Average value of residual displacement | Average value of maximum acceleration |
|---|---|---|---|
| 7,000 t/m | 5.2 cm | 0.88 cm | 37.7 gal |
| 14,000 t/m | 4.7 cm | 0.67 cm | 44.0 gal |
| 28,000 t/m | 4.2 cm | 0.40 cm | 58.0 gal |

As is clear from the comparison of the results given in Table 4 and the results shown in Table 3 of the simulation calculation as to the case with a maximum input acceleration of the seismic wave of 200 gal carried out on a conventional earthquake-proof foundation structure, in the earthquake-proof foundation structure of the present invention equipped with buffers comprising elastic rings having a spring constant of from 7,000 t/m to 28,000 t/m in total, the maximum acceleration produced in the coke oven battery of from 37.7 gal to 58.0 gal is slightly larger than the maximum acceleration of from 31 gal to 34 gal produced in the coke oven battery in the case of the conventional earthquake-proof foundation structure. However, the maximum relative displacement of from 4.2 cm to 5.2 cm and the residual displacement of from 0.40 cm to 0.88 cm produced in the coke oven battery in the case of the earthquake-proof foundation structure of the present invention are considerably smaller than the maximum relative displacement of 8.1 cm and the residual displacement of 4.9 cm produced in the coke oven battery in the case of the conventional earthquake-proof foundation structure, thus showing a remarkably improved earthquake-proof effect. In the present invention, as mentioned above, the longitudinal ridge 8 and the plurality of transverse ridges 8' provided on the lower surface of the bottom 5*a* of the sole flue 5 of the coke oven battery 4 respectively engage with the longitudinal groove 9 and the plurality of transverse grooves corresponding thereto provided on the upper surface of the base plate 3. Therefore, a relative displacement of a residual displacement does not occur between the base plate 3 and the coke oven batter 4, thus eliminating the risk of causing the coke oven battery 4 to be subjected to an unstable state in an earthquake.

In the Example given above, the lower surface of the bottom 5*a* of the sole flue 5 of the coke oven battery 4 is provided with the longitudinal ridge 8 and the plurality of transverse ridges 8', and the upper surface of the base plate 3 is provided with the longitudinal groove 9 and the plurality of transverse grooves corresponding thereto. However, the same effect is available by providing, in contrast, the upper surface of the base plate 3 with the ridges as mentioned above and providing the lower surface of the bottom 5*a* of the sole flue 5 with the grooves as mentioned above. The number of buffers is decided from designing considerations, depending upon the weight and the dimensions of the horizontal type coke oven battery. For example, in order to obtain a maximum relative displacement, a residual displacement and a maximum acceleration produced in the coke oven battery as those shown in Table 4 in the case of a horizontal type coke oven battery having a height of 7.5 m and 74 ovens, it suffices to use a pile plate 2 with a thickness "a" of 900 mm and a base plate 3 with a thickness "b" of 700 mm, fitted with about 175 buffers each comprising a bolt 10 having a length "c" of 800 mm and a diameter "d" of 170 mm and an elastic rubber ring 12 having a penetration of from about 55° to about 65°.

According to the earthquake-proof foundation structure for a horizontal type coke oven battery of the present invention, as described above in detail, not only it is possible to obtain excellent earthquake-proof effects including the minimization of the maximum relative displacement, the residual displacement and the maximum acceleration produced in a horizontal type coke oven battery through a considerable reduction of the input acceleration of a seismic wave transmitted to the coke oven battery and the maintenance of said coke oven battery in a stable state, but also it is possible to smoothly release the expansion and contraction moments of the coke oven battery caused by heat, thus providing many industrially useful effects.

What is claimed is:

1. An earthquake-proof foundation structure for a horizontal type coke oven battery, which comprises:

a plurality of foundation piles driven substantially vertically into the ground;

a pile plate rigidly connected substantially in a horizontal position to the tops of said plurality of foundation piles;

a base plate for mounting thereon a horizontal type coke oven battery, said base plate being placed substantially in a horizontal position on said pile plate, said coke oven battery comprising a regenerator, a plurality of coking ovens and combustion chambers alternately arranged in the horizontal direction on said regenerator, and a sole flue installed directly below said regenerator; and two sliding layers each arranged between said pile plate and said base plate and between said base plate and said sole flue of said coke oven battery, each of said two sliding layers being formed by tightly laying a plurality of steel sheets coated with graphite grease over the entire surface thereof into at least two laminations, among the surfaces of said plurality of steel sheets, those being in contact with the upper surface of said pile plate, the lower surface of said base plate, the upper surface of said base plate and the lower surface of said sole flue of said coke oven battery not being coated with graphite grease;

said foundation structure being characterized in that:

one of the lower surface of said sole flue of said coke oven battery and the upper surface of said base plate is provided with a longitudinal ridge and a plurality of transverse ridges, while one of the upper surface of said base plate and the lower surface of said sole flue of said coke oven battery is provided with a longitudinal groove and a plurality of transverse grooves to engage with said longitudinal ridge and said plurality of transverse ridges at locations corresponding to said riges, thereby said coke oven battery being mounting on said base plate in a state in which said longitudinal ridge and said plurality of transverse ridges respectively engage with said longitudinal groove and said plurality of transverse grooves corresponding thereto; and said pile plate and said base plate are connected to each other on the both longitudinal sides thereof by a plurality of buffers each of which comprises a bolt fixed with a plurality of reinforcing ribs at the lower portion thereof and an elastic ring engaging with the upper portion of said bolt.

2. The earthquake-proof foundation structure as claimed in claim 1, wherein:

each of said plurality of buffers is fitted to said pile plate and said base plate by inserting each of said plurality of buffers substantially vertically into each of a plurality of fitting holes pierced in said base plate on the both sides in the longitudinal direction thereof and into each of a plurality of fitting recesses provided on the upper surface of said pile plate corresponding to said plurality of fitting holes of said base plate so that said plurality of reinforcing ribs of said bolt may be located in said fitting recess of said pile plate and said elastic ring engaging with the upper portion of said bolt may be located in said fitting hole of said base plate; whereby said pile plate and said base plate are connected to each other.

3. The earthquake-proof foundation structure as claimed in claim 1, wherein:

each of said plurality of buffers is fitted to said pile plate and said base plate by previously burring the lower portion of said bolt fixed with said reinforcing ribs substantially vertically at prescribed intervals into the upper surface of said pile plate on the both sides in the longitudinal direction thereof; and by inserting said elastic ring into each of a plurality of fitting holes pierced in said base plate at the location corresponding to said bolt to cause said elastic ring to engage with the upper portion of said bolt; whereby said pile plate and said base plate are connected to each other.

* * * * *